US005785536A

United States Patent [19]

McCartin et al.

[11] Patent Number: 5,785,536

[45] Date of Patent: Jul. 28, 1998

[54] CONNECTOR HAVING PRESS FIT MATING SHROUDS

[75] Inventors: Doug E. McCartin, Henryville, Ind.; John K. Hynes, Louisville, Ky.; Brian A. Striegel, New Albany, Ind.

[73] Assignee: Santec, Inc., New Albany, Ind.

[21] Appl. No.: 642,915

[22] Filed: May 6, 1996

Related U.S. Application Data

[63] Continuation-in-part of Ser. No. 479,127, Jun. 7, 1995, Pat. No. 5,655,914.

[51] Int. Cl.[6] ..... H01R 23/72

[52] U.S. Cl. ..... 439/78; 439/374

[58] Field of Search ..... 439/78, 246, 247, 439/248, 374, 378, 540, 677, 680, 717

[56] References Cited

U.S. PATENT DOCUMENTS

| | | | |
|---|---|---|---|
| 4,173,387 | 11/1979 | Zell | 339/196 |
| 4,603,930 | 8/1986 | Ito | 339/17 |
| 4,761,141 | 8/1988 | Hawk et al. | 439/153 |
| 4,871,320 | 10/1989 | Mouissie | 439/78 |
| 4,978,308 | 12/1990 | Kaufman | 439/83 |
| 4,998,887 | 3/1991 | Kaufman et al. | 439/78 |
| 5,037,323 | 8/1991 | Locati | 439/374 |
| 5,129,831 | 7/1992 | Locati | 439/79 |
| 5,147,226 | 9/1992 | Kile | 439/680 |
| 5,161,996 | 11/1992 | Locati | 439/374 |
| 5,180,312 | 1/1993 | Martin | 439/78 |
| 5,199,880 | 4/1993 | Arai | 439/78 X |
| 5,261,827 | 11/1993 | Lenzi et al. | 439/78 |

*Primary Examiner*—Jes F. Pascua

*Attorney, Agent, or Firm*—Woodard, Emhardt, Naughton Moriarty & McNett

[57] ABSTRACT

Connectors formed from long strips of pin headers, which are cut to a length equal to the desired number of connector positions. A pre-molded shroud is then press fit to each end of the cut pin header. The pre-molded shrouds include longitudinally extending arms which engage sides of the pin header in order to firmly hold the shroud in place after placement. Because none of the connector positions on the end of the cut pin header are covered by the shrouds, the completed connector includes the desired number of connector positions. As with the other embodiments of the present invention, the only items that must be inventoried are the long strips of pin headers and the pre-molded shrouds. Any desired size of connector may be formed from these two components.

9 Claims, 7 Drawing Sheets

CONNECTOR HAVING PRESS FIT MATING SHROUDS

CROSS-REFERENCE TO RELATED APPLICATIONS

The present application is a continuation-in-part of U.S. patent application Ser. No. 08/479,127, filed Jun. 7, 1995, now U.S. Pat. No. 5,655,914.

TECHNICAL FIELD OF THE INVENTION

The present invention relates generally to electrical connectors and, more particularly, to a connector having press fit mating shrouds.

BACKGROUND OF THE INVENTION

Many electrical connectors are in the form of pin headers. The pin header contains a pin field which is mounted to the body of the header and each of the pins of the pin field are soldered to an electrical circuit board using either surface mount techniques or pin through-holes. The pin header is designed to receive a complementary mating connector which is typically terminated in a socket.

It is typically desirable that the pin header include a housing, or shroud, which extends above the height of the pin field. This is because such connectors are often "blind mated", which refers to the fact that the two connector halves are not always directly visible to the person mating them together. Blind mating is not practical if there is no shroud structure to provide guidance to the complementary mating connector. When blind mating a complementary connector to such a pin header without a shroud, there is no structure on the pin header to assure that the pins in the pin header and the receptacle contacts in the complementary mating connector are aligned before mating forces are applied. This can be potentially damaging, resulting in bent pins or misaligned connectors. Upon unmating a mated complementary connector from such an unshrouded pin header, there is nothing to prevent the mating connector from being tilted and thus removed in an arc rather than being removed parallel to the direction of the pins. Such an arcuate removal path, known as peeling, can also result in bent pins.

Therefore, connectors are often formed with integral housings which form a shroud that completely, or substantially completely, surrounds the pin field and extends to a height that is above the height of the pin field. Such a shroud guides the mating connector into alignment with the pin field before mating pressures are applied between the two connector halves. This presents a problem, however, in that the connectors are formed in many different sizes, each size having a specified number of pins in the pin field. Because such connectors are formed with a housing shroud encircling the pin field, it is necessary to keep an inventory of each connector size in stock, greatly increasing the inventory carrying costs. If the integral housing shroud were not required, the pin fields could be stocked in long strips and merely "cut to position" (i.e. cut to the desired length for the connector size required), as is presently done with unshrouded connectors. This would greatly decrease the inventory carrying costs because separate connector sizes would not have to be carried in inventory.

There is therefore a need in the connector industry for a way to provide shrouded connectors without requiring that many sizes of connectors be carried in inventory. The present invention is directed toward meeting this need.

SUMMARY OF THE INVENTION

The present invention relates to connectors having press fit mating shrouds. The connectors are formed from long strips of pin headers, which are cut to a length equal to the desired number of connector positions plus four additional positions. A pre-molded shroud is then press fit to each end of the cut pin header. The pre-molded shrouds include vertical holes which are sized to fit snugly over the pins on the end position of the cut pin header in order to remain in place after placement. Additionally, the shrouds include vertical slots which snugly receive the pins on the second-to-last position on each end of the pin header. Because the last two positions on each end of the cut pin header are covered by the shrouds, the completed connector includes the desired number of connector positions. Furthermore, the only items that must be inventoried are the long strips of pin headers and the pre-molded shrouds. Any desired size of connector may be formed from these two components.

In another embodiment of the present invention, the connectors are formed from long strips of pin headers, which are cut to a length equal to the desired number of connector positions. A pre-molded shroud is then press fit to each end of the cut pin header. The pre-molded shrouds include longitudinally extending arms which engage sides of the pin header in order to firmly hold the shroud in place after placement. Because none of the connector positions on the end of the cut pin header are covered by the shrouds, the completed connector includes the desired number of connector positions. As with the other embodiments of the present invention, the only items that must be inventoried are the long strips of pin headers and the pre-molded shrouds. Any desired size of connector may be formed from these two components.

In one form of the invention, an electrical connector is disclosed, comprising a pin header comprising a body and a plurality of pins; a first shroud having a first end wall and first and second side walls arranged in substantially a C-configuration, wherein the first shroud is coupled to a first end of the pin header; and a second shroud having a second end wall and third and fourth side walls arranged in substantially a C-configuration, wherein the second shroud is coupled to a second end of the pin header.

In another form of the invention, a shroud adapted for coupling to a pin header is disclosed, the shroud comprising a shroud body having a substantially C-shaped configuration and including an end wall, a first side wall and a second side wall; and a first engagement feature formed integrally with at least one of the first and second side walls and adapted to engage a second engagement feature formed integrally with the pin header in order to couple the shroud to the pin header.

In another form of the invention, a method of forming an electrical connector having a number of positions is disclosed, comprising the steps of: (a) providing a pin header having said number of positions; and (b) coupling first and second shrouds to the pin header, wherein a first engagement feature of each of the first and second shrouds engages a second engagement feature of the pin header.

DESCRIPTION OF THE PREFERRED EMBODIMENT

Figure 1:
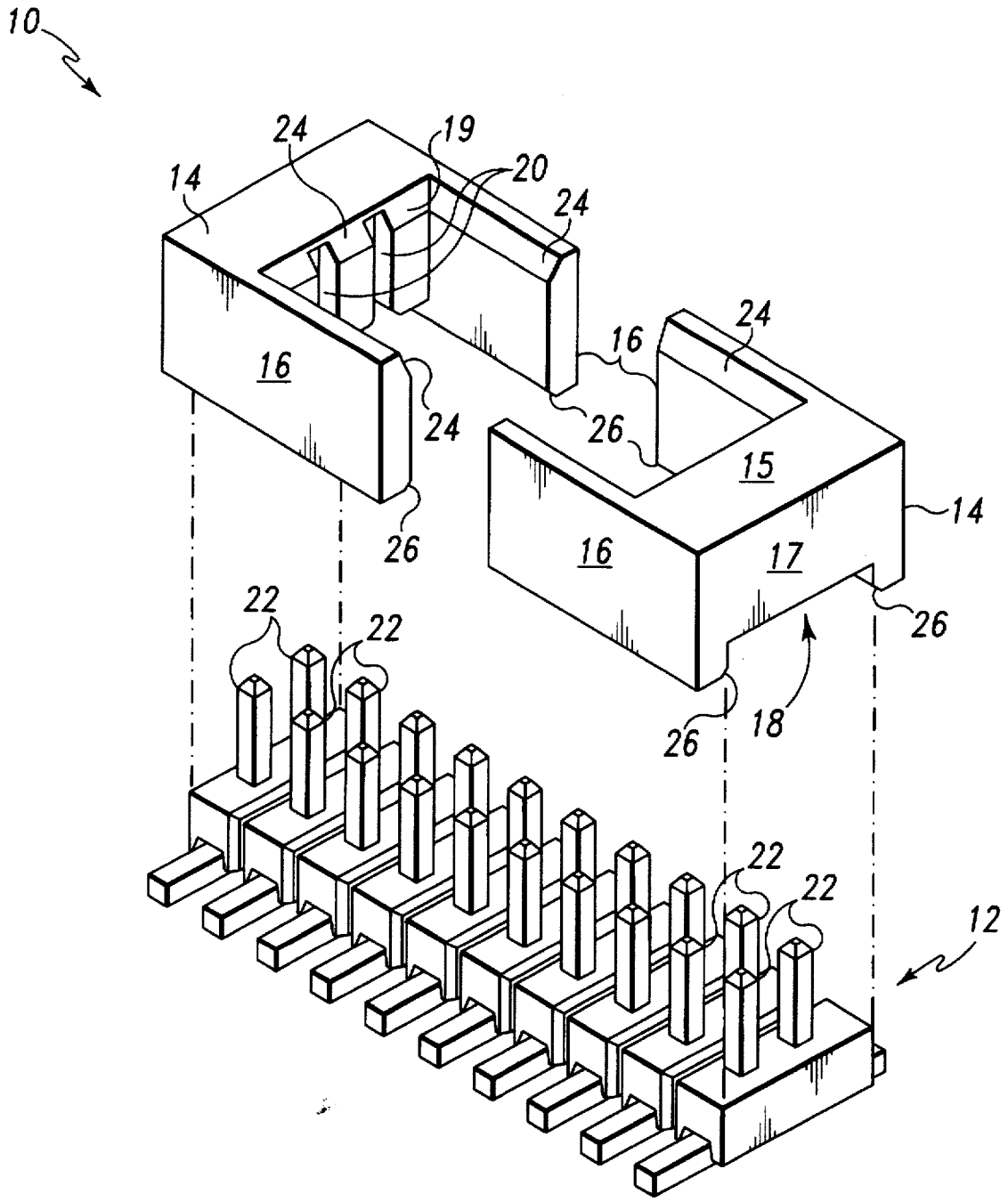
FIG. 1 is an isometric exploded view of a first embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention allows shrouded connectors of any number of pin positions to be formed without requiring that each of the separately sized connectors be carried in inventory. Referring to FIG. 1, there is illustrated an exploded perspective view of a first embodiment shrouded connector of the present invention, indicated generally at 10. The connector 10 is formed from a pin header 12 which has four extra positions (i.e. eight more pins for a two row connector) beyond the number of positions required for the completed connector. The pin header 12 illustrated in FIG. 1 is of the surface mount variety, however it will be appreciated by those skilled in the art that the concepts of the present invention are equally applicable to connectors which are mounted with through-holes. The pin header 12 is cut from a longer pin header strip at the time that it is desired to form the connector. The pin header 12 is cut from one of these longer strips to a length which includes four more positions than is required for the finished connector. Because of this, it is only necessary for the connector manufacturer to inventory the long pin header strips. For example, only pin header strips having 50 positions could be inventoried, thereby allowing the manufacture of connectors in any size from 46 positions and smaller.

The connector shroud is formed by fitting two separately molded shrouds 14 to opposite ends of the pin header 12. The molded shrouds 14 are identical in configuration no matter what size connector is being assembled. It is therefore possible to produce the shrouds 14 in large quantities and carry only a single size in inventory. As a result, any size connector may be manufactured using only two inventoried parts: the long pin header and the shrouds 14.

Each of the shrouds 14 include a top surface 15, a first end surface 17, a bottom surface 18, a second end surface 19 and side walls 16 which extend partially toward the center of the connector 10. The separation between the inside surfaces of opposing side walls 16 is formed to be just slightly larger than the outside dimension of the pin header 12 so that the shrouds 14 will be snugly received upon the pin header 12. The side walls 16 extend down below the bottom surface 18 of the shroud body so that the side walls 16 may wrap around the base of the pin header 12 when the shroud 14 is firmly seated thereon.

Figure 5:
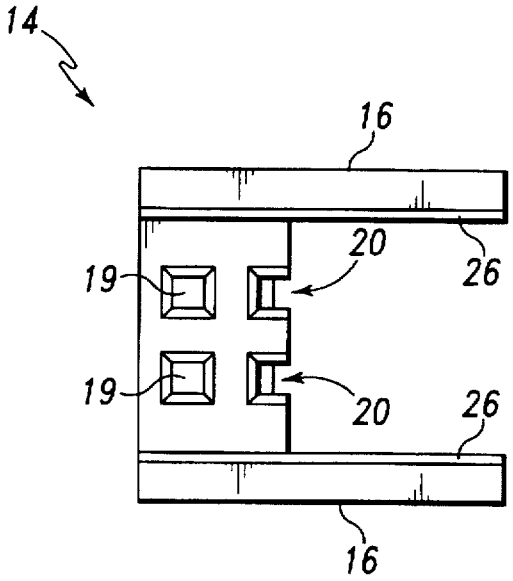
FIG. 5 is a bottom plan view of the first embodiment mating shroud of the present invention.

Each of the shrouds 14 include two vertical holes 19 (see FIG. 5) and two vertical channels 20 formed in the main body of the shroud 14. The vertical holes 19 and channels 20 are sized and positioned such that they receive the four pins on the end position of the pin header 12 when the shroud 14 is mated with the end of the pin header 12. The dimensions of the shroud 14 are such that the tight fit between the vertical holes 19 and channels 20 and the end position pins 22, as well as the tight fit between the end walls 16 and the body of the pin header 12, provide a secure mating between the shroud 14 and the pin header 12. It is therefore only necessary to press a shroud 14 onto each end of the pin header 12 in order to assemble the finished connector 10. No other coupling between the shroud 14 and the pin header 12 is required, although further coupling means may be added for added security against future inadvertent disassembly.

The upper inside edges of the shrouds 14 include beveled surfaces 24 which facilitate to guide the mating complementary connector into proper alignment with the pin header 12 during subsequent connector blind mating. Additionally, the bottom inside edges of the side walls 16 include beveled edges 26 which facilitate proper alignment between the shrouds 14 and the pin header 12 during assembly of the connector 10.

Figure 2:
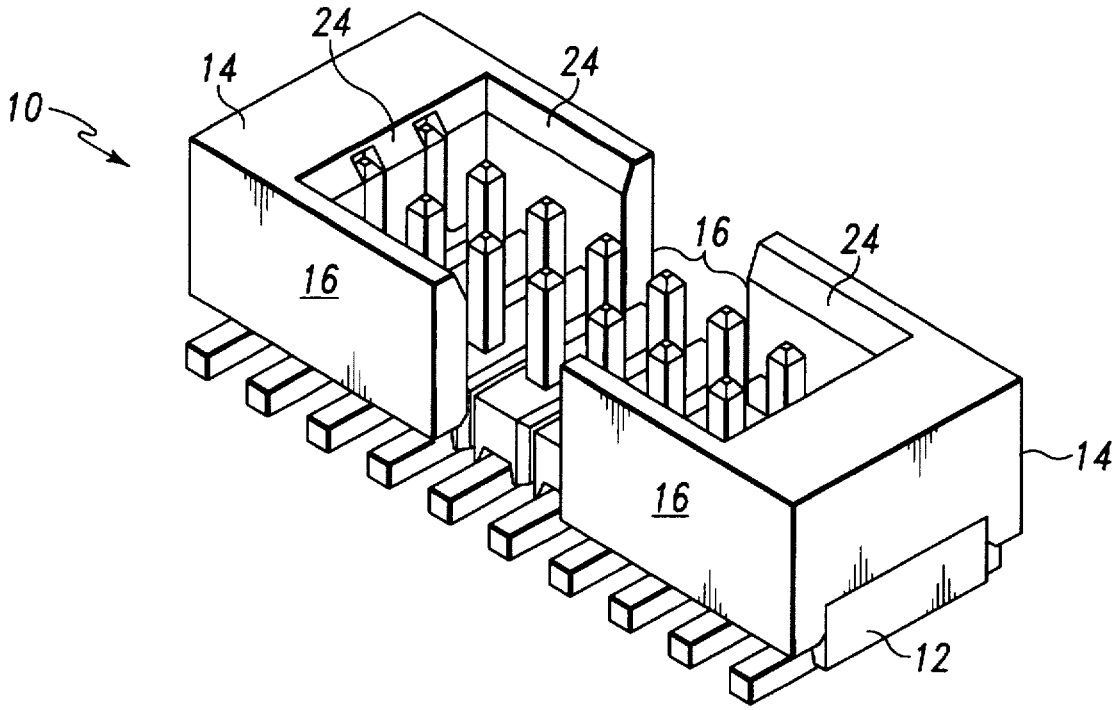
FIG. 2 is an isometric view of the first embodiment of the present invention.

The assembled connector 10 is illustrated in FIG. 2, wherein a pair of shrouds 14 have been assembled to the end positions of the pin header 12. It will be appreciated by those skilled in the art that the pin header 12 must be cut to include four extra positions in order to account for the fact that the shrouds 14 substantially cover the two end positions on each end of the connector 10, rendering these end positions unusable for connector mating purposes.

Figure 3:
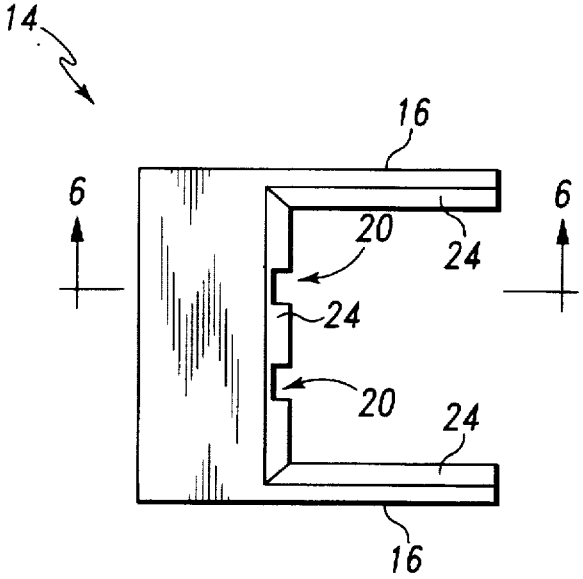
FIG. 3 is a top plan view of the first embodiment mating shroud of the present invention.

Referring now to FIG. 3, the shroud 14 of the present invention is illustrated in a top plan view. From this perspective, it can be seen that the beveled surfaces 24, which are disposed on all of the inside top edges of the shroud 14, will greatly facilitate the guiding of the mating complementary connector into proper alignment with the pins on the pin header 12. This substantially eliminates the risk of bent pins due to misalignment of the connector halves during blind mating.

Figure 4:
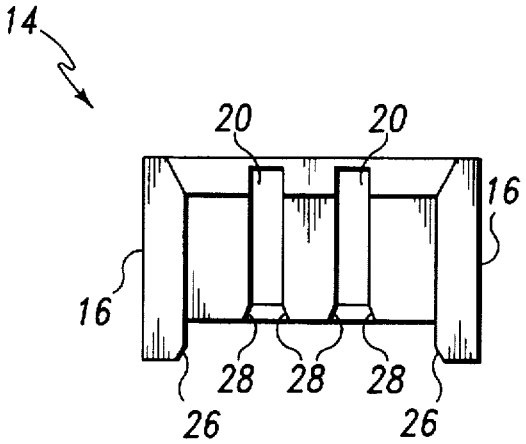
FIG. 4 is an elevational view of the first embodiment mating shroud of the present invention.
Figure 6:
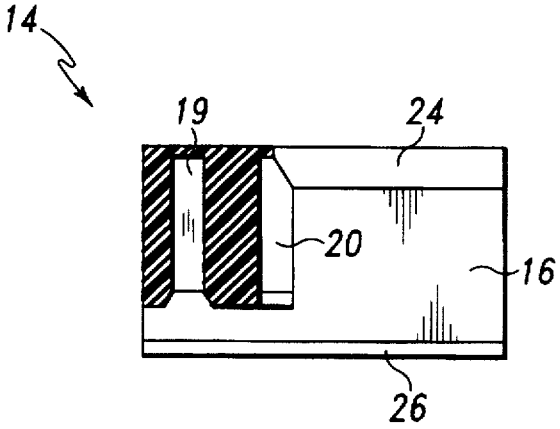
FIG. 6 is a cross-sectional view of the first embodiment mating shroud of the present invention.

The shroud 14 of the present invention is illustrated in a first end elevational view in FIG. 4. The view of FIG. 4 is of the interior of the shroud 14 and the vertical slots 20 which mate with the pins of the second-to-end position of the pin header 12 are clearly visible. The bottom edges of the vertical holes 19 and slots 20 include beveled surfaces 28 which facilitate the proper orientation of the shroud 14 to the pins 22 on the two end positions of the pin header 12. This helps to ensure that the end position pins 22 are not bent during assembly of the shroud 14 onto the pin header 12. The beveled edges 26 on the bottoms of the side walls 16 also assist in proper orientation of the shroud 14 with respect to the pin header 12 during mating of these two portions. A bottom plan view of the shroud 14 is illustrated in the FIG. 5, in which the vertical holes 19 are visible. FIG. 6 illustrates a cross-sectional view of the first embodiment mating shroud of the present invention.

It will be appreciated by those skilled in the art that by incorporating the teachings of the present invention, any sized shrouded connector may be formed from only two inventoried parts. The first inventoried part is a long pin header, which contains 50 positions (i.e. 100 pins for a two row connector) in a preferred embodiment. The second inventoried part is the blind mating shroud 14. Two shrouds 14 are used in the formation of each connector 10 of the present invention. The long pin header strips are cut to position when it is determined what size connector is required. For example, if a 20 position connector is required, one of the long pin header strips from inventory is cut to 24 positions. A pair of molded shrouds 14 are then fit to the pin header such that each shroud 14 covers the pins 22 on each of the extra end positions. Once assembled, the shrouds 14 provide adequate blind mating assist during subsequent blind mating of the assembled connector 10 with a complementary mating connector. Because the pin header 12 of the connector 10 must be cut to position with four extra positions than are required for the finished connector, inventorying long pin header strips of 50 positions will allow any connector size having 46 positions or less to be manufactured. Obviously, long pin header strips having more or fewer positions could be carried in inventory in order to facilitate formation of connectors of various ranges of positions.

In a preferred embodiment of the present invention, the press fit shrouds 14 are injection molded plastic and are formed by injection molding processes which are notoriously well known in the art. The pin header strips which are used in the present invention are of the type commonly used in the connector industry.

Figure 7:
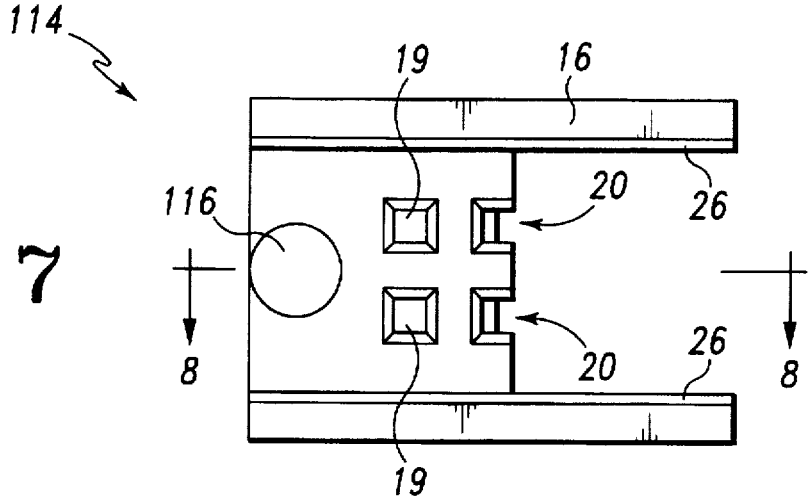
FIG. 7 is a bottom plan view of a second embodiment mating shroud of the present invention.
Figure 8:
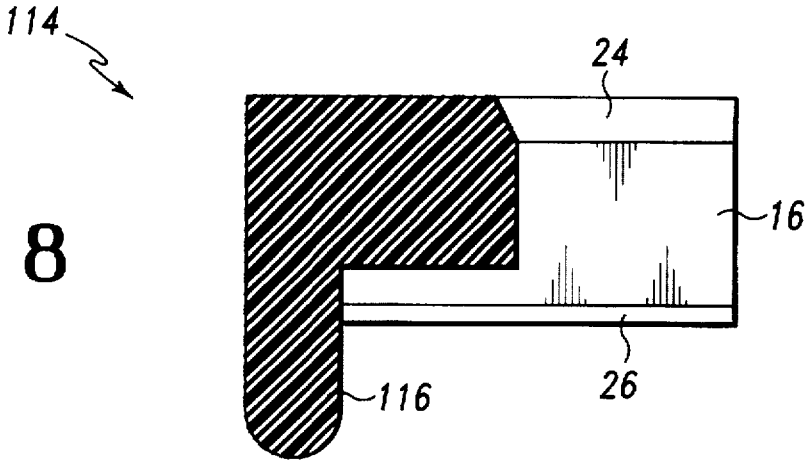
FIG. 8 is a cross-sectional view of the second embodiment mating shroud of the present invention.
Figure 9:
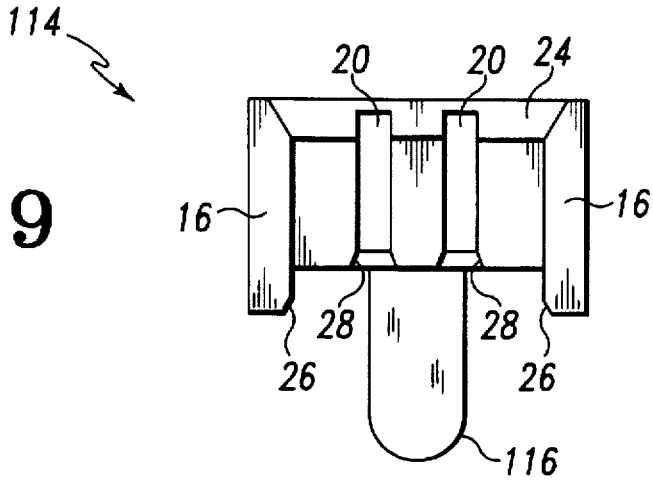
FIG. 9 is an end elevational view of the second embodiment mating shroud of the present invention.

Referring now to FIG. 7, there is illustrated a second embodiment mating shroud of the present invention, indicated generally at 114. The shroud 114 is substantially identical to the shroud 14 with the exception that the shroud 114 includes an alignment pin 116 integrally molded therewith. The alignment pin 116 is adapted to mate with an alignment hole in the circuit board holding the shrouded connector. The mating of the alignment pin 116 with such a mating hole ensures alignment of the connector pins with their respective solder pads or through holes on the circuit board. The shroud 114 is illustrated in cross section in FIG. 8 and in an end elevational view in FIG. 9.

Figure 10:
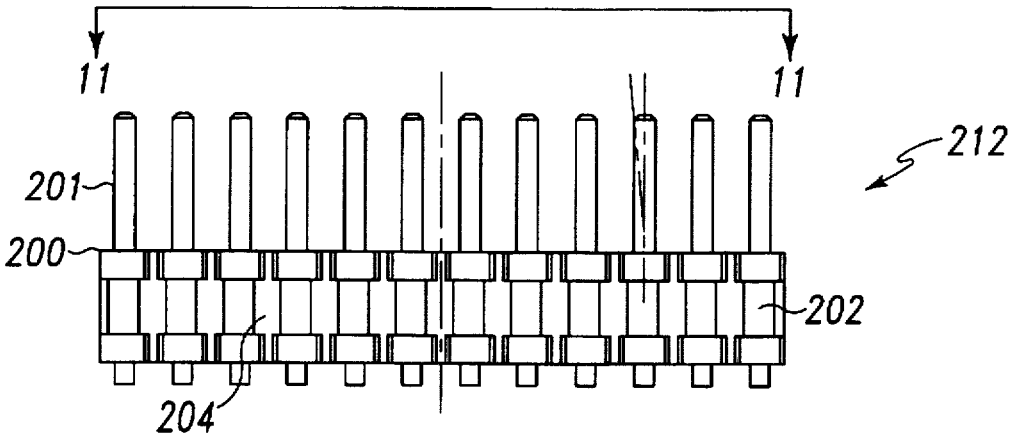
FIG. 10 is a side elevational view of a pin header for use with a third embodiment mating shroud of the present invention.
Figure 11:
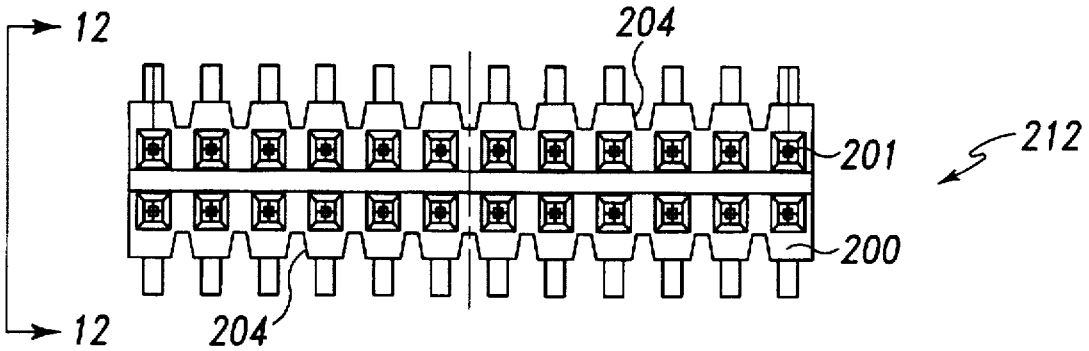
FIG. 11 is a top plan view of the pin header of FIG. 10.
Figure 12:
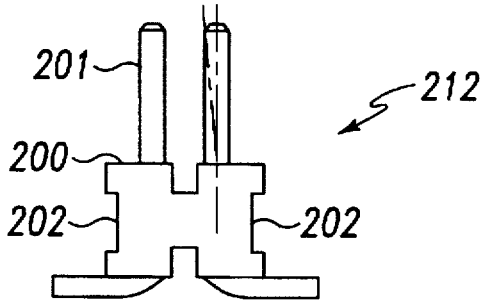
FIG. 12 is an end elevational view of the pin header of FIG. 10.

Referring now to FIGS. 10–12, there is illustrated a pin header 212 which is similar to the pin header 12 of FIG. 1. The pin header 212 comprises a body 200 and a plurality of pins 201 extending therefrom. The pin header 212 illustrated in FIGS. 10–12 is of the surface mount variety, however it will be appreciated by those skilled in the art that the concepts of the present invention are equally applicable to connectors which are mounted with through-holes. The pin header 212 includes a longitudinal channel 202 extending the entire length of each side of the pin header. Furthermore, the pin header 212 includes an indentation 204 formed into each side of the pin header at locations between each of the pin positions. The placement of the indentations 204 between pin positions is for convenience, such positioning not being critical to the present invention.

The pin header 212 is cut from a longer pin header strip at the time that it is desired to form the connector. The pin header 212 is cut from one of these longer strips to a length which includes the exact number of positions that are required for the finished connector. Therefore, the third embodiment of the present invention does not require the four extra positions required for the first and second embodiments. Because the pin header 212 for any size connector is cut from one of the longer pin header strips, it is only necessary for the connector manufacturer to inventory the long pin header strips. For example, only pin header strips having 50 positions could be inventoried, thereby allowing the manufacture of shrouded connectors in any size from 50 positions and smaller.

Figure 13:
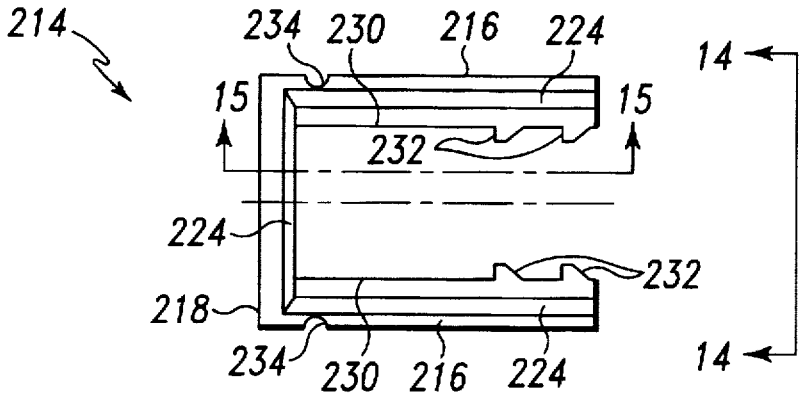
FIG. 13 is a top plan view of a third embodiment mating shroud of the present invention.
Figure 14:
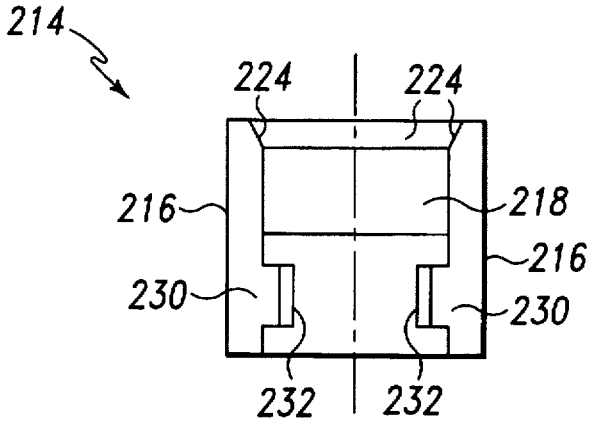
FIG. 14 is an elevational view of the third embodiment mating shroud of the present invention.
Figure 15:
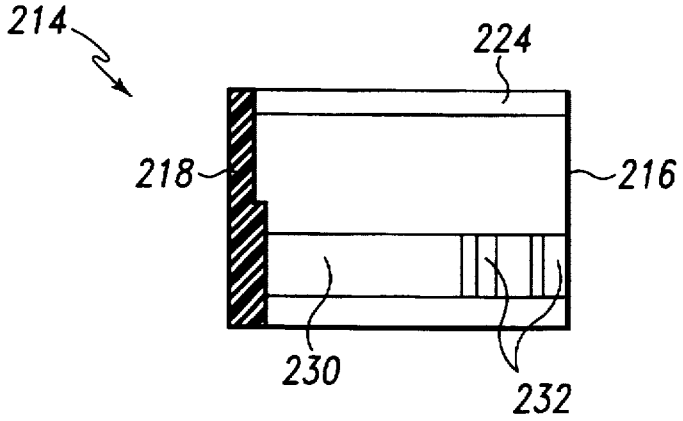
FIG. 15 is a cross-sectional view of the third embodiment mating shroud of the present invention.

Referring now to FIGS. 13–15, the third embodiment connector shroud is formed by fitting two separately molded shrouds 214 to opposite ends of the pin header 212. The molded shrouds 214 are identical in configuration no matter what sized connector is being assembled. It is therefore possible to produce the shrouds 214 in large quantities and carry only a single size in inventory. As a result, any sized connector may be manufactured using only two inventoried parts: the long pin header and the shrouds 214.

Each of the shrouds 214 is formed in a C-configuration, including two longitudinal arms 216 and an end wall 218. The separation between the inside surfaces of opposing side walls 216 is formed to be approximately equal to or slightly less than the outside dimension of the pin header 212 so that the shrouds 214 will be snugly received upon the pin header 212. The inside surface of each side wall 216 includes a longitudinally extending rail 230 which is positioned and sized so as to slide in longitudinal engagement with the two channels 202 formed into the sides of the pin header 212. Each of the rails 230 further include at least 1, and preferably 2, barbed projections 232 which are shaped to be received within the indentations 204 on each side of the pin header 212.

Figure 16:
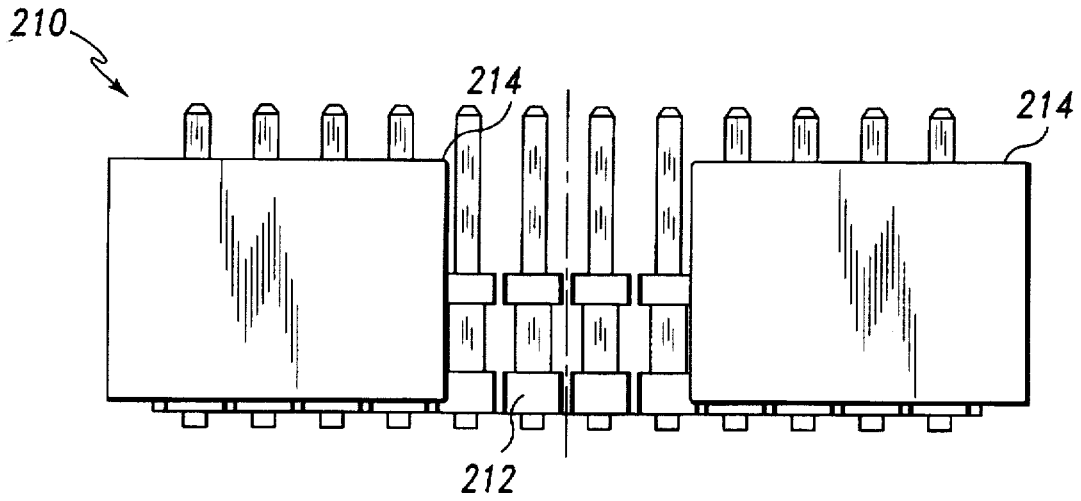
FIG. 16 is a side elevational view of the third embodiment mating shroud of the present invention mounted on a pin header.
Figure 17:
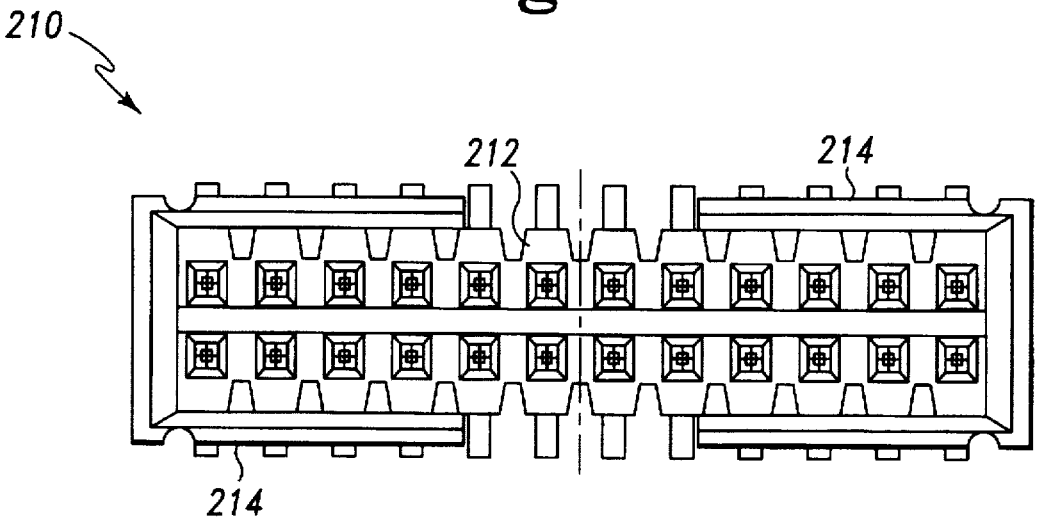
FIG. 17 is a top plan view of the third embodiment mating shroud of the present invention mounted on a pin header.
Figure 18:
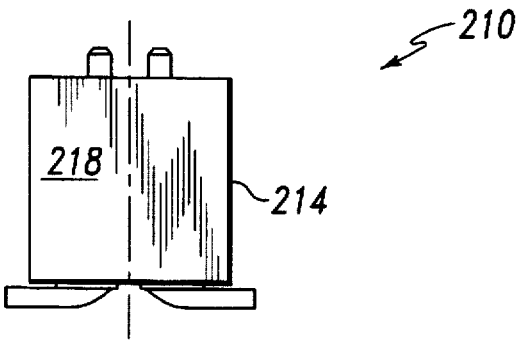
FIG. 18 is an end elevational view of the third embodiment mating shroud of the present invention mounted on a pin header.

In order to assemble the mating shrouds 214 to the pin header 212, a shroud 214 is engaged with each end of the pin header 212 such that the rails 230 slide longitudinally within the grooves 202 of the pin header 212. The shroud 214 is then pushed onto the pin header 212 until the end wall 218 of the shroud 214 comes into contact with the end of the pin header 212. The barbs 232 on each side of the shroud 214 will engage indentations 204 on the pin header 212 at this final position, thereby preventing the shroud 214 from being backed off of the pin header 214. Furthermore, engagement of the rails 230 with the grooves 202 prevents the shroud 214 from moving off of the pin header 212 in a direction perpendicular to the grooves 202. The sides of the barbs 232 which face away from the shroud's end wall 218 are formed at a slight angle in order to facilitate disengagement of the barbs 232 from the indentations 204 as the shroud 214 is being slid onto the pin header 212. However, the sides of the barbs 232 which face the shroud end wall 218 are formed substantially perpendicular to the side walls 216, thereby preventing backwards movement of the shroud 214 off of the pin header 212 by engagement of this perpendicular surface with the indentations 204. It is therefore only necessary to press a shroud 214 onto each end of the pin header 212 in order to assemble the finished connector 210, as illustrated in FIGS. 16–18. No other coupling between the shroud 214 and the pin header 212 is required, although further coupling means may be added for added security against future inadvertent disassembly.

The upper inside edges of the shrouds 214 include beveled surfaces 224 which facilitate to guide the mating complimentary connector into proper alignment with the pin header 212 during subsequent connector blind mating. The beveled surfaces 224 are formed on the side walls 216 and the end wall 218. The outside surface of each side wall 216 further includes a semi-circular groove 234 formed therein near the end wall 218. The groove 234 provides a flexure point for each side wall 216 in order to allow the side walls 216 to expand around the sides of the pin header 212 prior to engagement of the barbs 232 with the indentations 204.

The assembled connector 210 is illustrated in FIGS. 16–18, wherein a pair of shrouds 214 have been assembled to the ends of the pin header 212. It will be appreciated by those skilled in the art that the pin header 212 is cut to the same number of positions required for the finished connector 210, thereby eliminating the need to cut the pin header to four extra positions as required with the first and second embodiment shrouds of the present invention.

It will also be appreciated by those skilled in the art that by incorporating the teachings of the third embodiment of the present invention, any sized shrouded connector may be formed from only two inventoried parts. The first inventoried part is a long pin header, which contains 50 positions (i.e. 100 pins for a two row connector) in a preferred embodiment. The second inventoried part is the blind mating shroud 214. Two shrouds 214 are used in the formation of each connector 210 of the present invention. The long pin header strips are cut to position when it is determined what size connector is required. For example, if a twenty position connector is required, one of the long pin header strips from the inventory is cut to twenty positions. A pair of molded shrouds 214 are then fit to each end of the pin header 212. Once assembled, the shrouds 214 provide adequate blind mating assist during subsequent blind mating of the assembled connector 210 with a complementary mating connector. Because the pin header 212 of the connector 210 is cut to the same number of positions as required for the finished connector, inventorying long pin header strips of 50 positions will allow any connector size having 50 positions or less to be manufactured.

Obviously, long pin header strips having more or fewer positions can be carried in inventory in order to facilitate formation of connectors of various ranges of positions.

In a preferred embodiment of the present invention, the press fit shrouds 214 are injection molded plastic and are formed by injection molding processes which are notoriously well known in the art. The pin header strips 212 may also be formed by processes well known in the art, so long as provision is made in the plastic molds for the groove 202 and the indentations 204.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An electrical connector, comprising:

a pin header comprising a body and a plurality of pins, wherein the pin header body extends from a first end to a second end in a longitudinal direction perpendicular to an axis of each of the pins, the pin header body having periodically repeating first engagement features between the first and second ends;

wherein the pins are arranged in a grid of longitudinal rows and transverse rows;

wherein there is at least one first engagement feature for every transverse row;

a first shroud having a first end wall and first and second side walls arranged in substantially a C-configuration, wherein the first shroud is coupled to the first end of the pin header body and engages at least one of the periodically repeating first engagement features; and a second shroud having a second end wall and third and fourth side walls arranged in substantially a C-configuration, wherein the second shroud is coupled to the second end of the pin header body and engages at least one of the periodically repeating first engagement features.

2. The electrical connector of claim 1, wherein the pin header is of a surface mount configuration.

3. The electrical connector of claim 1, wherein the first and second shrouds are substantially identical.

4. The electrical connector of claim 1, further comprising:

a second engagement feature formed integrally with each of the first and second shrouds;

wherein the first and second engagement features are complementary and function to retain the first and second shrouds on the pin header once coupled thereto.

5. The electrical connector of claim 1, wherein:

the first shroud includes a first beveled top surface; and the second shroud includes a second beveled top surface.

6. An electrical connector, comprising:

a pin header comprising a body and a plurality of pins, wherein the pin header body extends from a first end to a second end in a longitudinal direction perpendicular to an axis of each of the pins;

a first shroud having a first end wall and first and second side walls arranged in substantially a C-configuration, wherein the first shroud is coupled to the first end of the pin header body;

a second shroud having a second end wall and third and fourth side walls arranged in substantially a C-configuration, wherein the second shroud is coupled to the end of the pin header body;

a first engagement feature formed integrally with the pin header;

a second engagement feature formed integrally with each of the first and second shrouds;

wherein the first and second engagement features are complementary and function to retain the first and second shrouds on the pin header once coupled thereto; and wherein the first engagement feature comprises at least one longitudinal groove formed in the pin header body; and the second engagement feature comprises at least one longitudinal rail formed on each of the first and second shrouds.

7. An electrical connector, comprising:

a pin header comprising a body and a plurality of pins, wherein the pin header body extends from a first end to a second end in a longitudinal direction perpendicular to an axis of each of the pins, the pin header body having periodically repeating first engagement features between the first and second ends;

wherein the pins are arranged in a grid of longitudinal rows and transverse rows;

wherein there is at least one first engagement feature for every transverse row;

a first shroud having a first end wall and first and second side walls arranged in substantially a C-configuration, wherein the first shroud is coupled to the first end of the pin header body;

a second shroud having a second end wall and third and fourth side walls arranged in substantially a C-configuration, wherein the second shroud is coupled to the second end of the pin header body;

a second engagement feature formed integrally with each of the first and second shrouds;

wherein such first and second engagement features are complementary and function to retain the first and second shrouds on the pin header once coupled thereto; and wherein each first engagement feature comprises at least one indentation formed in the pin header body; and the second engagement feature comprises at least one barb formed on each of the first and second shrouds.

8. A method of forming an electrical connector having a number of positions, comprising the steps of:

(a) providing a pin header having a plurality of pins and a body, wherein the pin header body extends from a first end to a second end in a longitudinal direction perpendicular to an axis of each of the pins; and (b) coupling first and second shrouds to the pin header body, wherein a first engagement feature of each of the first and second shrouds engages a second engagement feature of the pin header body by engaging at least one longitudinal rail on each of the first and second shrouds with at least one longitudinal groove formed in the pin header.

9. A method of forming an electrical connector having a number of positions, comprising the steps of:

(a) providing a pin header having a plurality of pins and a body, wherein the pin header body extends from a first end to a second end in a longitudinal direction perpendicular to an axis of each of the pins, the pin header body having periodically repeating first engagement features between the first and second ends;

wherein the pins are arranged in a grid of longitudinal rows and transverse rows;

wherein there is at least one first engagement feature for every transverse row; and (b) coupling first and second shrouds to the pin header body, wherein a second engagement feature of each of the first and second shrouds engages at least one of the first engagement features of the pin header body by engaging at least one barb formed on each of the first and second shrouds with at least one indentation formed in the pin header.

* * * * *

UNITED STATES PATENT AND TRADEMARK OFFICE

CERTIFICATE OF CORRECTION

PATENT NO : 5,785,536

DATED : July 28, 1998

INVENTOR(S) : McCartin, et al.

It is certified that error appears in the above-identified patent and that said Letters Patent is hereby corrected as shown below:

Cover Page, Item [73], Assignee "Santec, Inc." should be --Samtec, Inc.--.

Signed and Sealed this

Eighth Day of February, 2000

*Attest:*

Q. TODD DICKINSON

*Attesting Officer*

*Commissioner of Patents and Trademarks*